United States Patent [19]

Frost, Jr.

[11] Patent Number: 4,472,288

[45] Date of Patent: Sep. 18, 1984

[54] LUBRICANT COMPOSITION CONTAINING ALKALI METAL BORATE AND AN OIL-SOLUBLE AMINE SALT OF A PHOSPHORUS COMPOUND

[75] Inventor: Kenneth A. Frost, Jr., San Rafael, Calif.

[73] Assignee: Chevron Research Company, San Francisco, Calif.

[21] Appl. No.: 444,753

[22] Filed: Nov. 26, 1982

Related U.S. Application Data

[63] Continuation-in-part of Ser. No. 182,536, Aug. 29, 1980.

[51] Int. Cl.[3] ..... C10M 1/48; C10M 1/10; C10M 1/32

[52] U.S. Cl. ..... 252/32.7 E; 252/49.6; 252/49.9

[58] Field of Search ..... 252/32.7 E, 49.6

[56] References Cited

U.S. PATENT DOCUMENTS 3,203,895 8/1965 Latos et al. ..... 252/49.9
4,263,155 4/1981 Frost ..... 252/49.6

*Primary Examiner*—Jacqueline V. Howard
*Attorney, Agent, or Firm*—J. A. Buchanan; D. A. Newell; J. J. DeYoung

[57] ABSTRACT

Disclosed is a lubricant composition containing an oil of lubricating viscosity having dispersed therein a particulate hydrated alkali-metal borate and an effective amount oil soluble phosphate and/or monothiophosphate compound which stabilizes the composition against the adverse effects of water contamination. The weight ratio of phosphorus from phosphates and monothiophosphates to boron in the lubricant must be greater than 0.014.

10 Claims, No Drawings

LUBRICANT COMPOSITION CONTAINING ALKALI METAL BORATE AND AN OIL-SOLUBLE AMINE SALT OF A PHOSPHORUS COMPOUND

CROSS-REFERENCE TO RELATED APPLICATIONS

This application is a continuation-in-part of Ser. No. 182,536, filed Aug. 29, 1980, the entire disclosure of which is incorporated herein by reference.

BACKGROUND OF THE INVENTION

The invention relates to extreme pressure lubricating oils, particularly alkali metal borate-containing lubricants.

Alkali metal borate-containing lubricants are well known in the art for their usefulness as extreme pressure lubricating oils. See, for example, U.S. Pat. Nos. 3,313,727, 3,565,802, 3,819,521, 3,846,313, 3,853,772, 3,907,691, 3,912,639, 3,912,643, 3,912,644, 3,997,454, and 4,089,790.

The borate-containing oils, described in these patents, have a serious deficiency in service. If water is introduced into the system containing the borate lubricant, the borate crystallizes out of the oil and forms hard granules. This crystallization decreases the extreme pressure function of the lubricant. Furthermore, it has been found that water contamination of the borate lubricant can lead to seal leakage. It is believed that the crystallization is caused by water contamination which leads to the formation of deposits on shafts at or near the seals. The turning motion of the shafts then slowly abrades the seals, thereby allowing loss of the lubricant. Various alkali metal borate lubricants have been described in the patent literature as having improved properties relative to water contamination, e.g., U.S. Pat. Nos. 3,997,454 and 4,089,790. Both of these patents teach the use of dithiophosphates or salts of dithiophosphoric acid.

U.S. Pat. No. 3,997,454 claims a hydrated potassium borate with a boron-to-potassium ratio of 2.5 to 3.5 as being superior to other alkali metal borates in resisting the adverse effects of water contamination. Particularly preferred is a lubricant composition containing a potassium borate and antiwear agents selected from (a) zinc dihydrocarbyl dithiophosphate having 4 to 20 carbons in each hydrocarbyl group and (b) a $C_1$ to $C_{20}$ ester, $C_1$ to $C_{20}$ amide or $C_1$ to $C_{20}$ amine salt of a dihydrocarbyl dithiophosphoric acid or (c) mixtures thereof.

U.S. Pat. No. 4,089,790 claims a synergistic lubricant mixture containing (1) a hydrated potassium borate and (2) an antiwear agent selected from (a) zinc dihydrocarbyl dithiophosphate, (b) $C_1$–$C_{20}$ ester, $C_1$ to $C_{20}$ amide or $C_1$ to $C_{20}$ amine salt of a dihydrocarbyl dithiophosphoric acid, (c) zinc alkyl aryl sulfonate and (d) mixture thereof, and (3) oil soluble antioxidant organic sulfur compound. This composition is disclosed as having improved properties relative to water contamination.

It is one object of the present invention to provide an alkali metal borate-containing lubricant containing amine salts of phosphate and/or monothiophosphates having improved resistance to the adverse effects of water contamination as compared to the prior art compositions containing dithiophosphates.

SUMMARY OF THE INVENTION

It has been found 0.01 to 5.0 weight percent of an oil-soluble amine salt of a phosphorus compound of the formula:

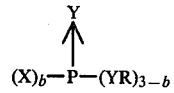

wherein:

b is 1, 2 or 3;

Y is O or optionally one Y is S;

R is an oil-solubilizing hydrocarbyl of 1 to 30 carbon atoms; and X is $ONH_{4-c}R'_c$ where c is 0, 1, 2, 3, or 4 and R' is a hydrocarbyl of 1 to 30 carbon atoms or an amino or hydroxy substituted alkyl group of 2 to 30 carbon atoms, is effective in stabilizing an alkali metal borate containing lubricant against water contamination when the weight ratio of phosphorus from phosphates and/or monothiophosphates to boron is greater than 0.014.

DETAILED DESCRIPTION OF THE INVENTION

The lubricant composition comprises an oil of lubricating viscosity, particulate hydrated alkali metal borate and an effective amount of an oil-soluble amine salt of a phosphate and/or monothiophosphate. It has been found that the borate lubricant compositions of the present invention which contain amine salt phosphates ($PO_4$) and/or monothiophosphates ($PO_3S$) and wherein the weight ratio of phosphorus from the phosphates and/or monothiophosphates to boron is greater than 0.014 are superior to the prior art borate-containing lubricant compositions which contain zinc or amine salts of dithiophosphates.

THE ALKALI-METAL BORATES

The hydrated particulate alkali-metal borates are well known in the art and are available commercially. Representative patents disclosing suitable borates and methods of manufacture include: U.S. Pat. Nos. 3,313,727; 3,819,521; 3,853,772; 3,907,601; 3,997,454; and 4,089,790, the entire disclosures of which are incorporated herein by reference.

The hydrated alkali-metal borates can be represented by the following formula:

$$M_2O.mB_2O_3.nH_2O$$

where M is an alkali metal of atomic number in the range 11 to 19, i.e., sodium and potassium, m is a number from 2.5 to 4.5 (both whole and fractional), and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The alkali-metal borate will generally comprise 0.1 to 60 weight percent of the lubricant, preferably 0.5 to 15 weight percent.

THE OIL-SOLUBLE AMINE SALTS OF A PHOSPHATE AND/OR MONOTHIOPHOSPHATE

The lubricant composition contains an effective amount of an oil-soluble amine salt of a phosphorus compound to inhibit crystallization caused by water contamination of the lubricant. The phosphorus compound is a phosphate (sulfur free) or monothiophosphate or mixtures thereof. Preferred is a mixture of phosphates and monothiophosphates. Generally the lubricant will contain 0.01 to 5.0 weight percent of the oil-soluble phosphate and monothiophosphate compounds and preferably 0.1 to 2.0 weight percent.

An effective amount of the phosphate and monothiophosphate will depend on the amount of alkali metal borate present in the lubricant. The weight ratio of phosphorus for phosphates and monothiophosphates to boron in the alkali metal borate must be greater than 0.014, preferably in the range 0.015 to 0.05, and more preferably in the range of 0.02 to 0.03.

The oil-soluble amine salts of the phosphorus compound, i.e., the phosphate and/or monothiophosphate, may be represented by the formula:

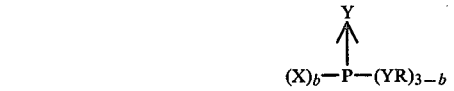

wherein:

b is 1, 2 or 3;

Y is O or optionally one Y is S;

R is an oil-solubilizing hydrocarbyl of 1 to 30 carbon atoms; and X is $—ONH_{4-c}R'_c$, where c is 0, 1, 2, 3, or 4 and R' is a hydrocarbyl group of 1 to 30 carbon atoms or an amino or hydroxy substituted group of 2 to 30 carbon atoms.

The R, and R' are alkyl groups which make the phosphorus compound oil-soluble. Generally, in order to provide oil solubility, the number of carbon atoms in all the R groups must be greater than 7. Preferably, the oil-solubilizing groups contain 7 to 70 or more carbon atoms and more preferably, from 12 to 20 carbon atoms. Also, preferred in the above formula, b is 1.

Representative phosphorus-containing compounds having the above structure are sulfur-free phosphates and monothiophosphates, such as:

ammonium dioctyl phosphate
benzylammonium O,S-diundecyl phosphorothiolate
tetramethylammonium dibutyl phosphate
octadecylammonium diethyl phosphate
pyridinium diethyl phosphate
dilaurylammonium methyl phosphate
stearylammonium dibutyl phosphate
oleylammonium diethyl phosphate
cerotylammonium dimethyl phosphate
myrstylammonium O-butyl S-hexyl phosphorothiolate
palmitylammonium di-2-ethylhexyl phosphate.

The lubricating oil to which the borates and the oil-soluble phosphates are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Preferred dispersants include the well known succinimide and ethoxylated alkylphenols and alcohols but exclude the zinc alklyl aryl sulfonates. Particularly preferred additional additives are the oil-soluble succinimides and oil-soluble alkali or alkaline earth metal sulfonates.

EXAMPLES

To 100 ml samples of a base oil containing 9 weight percent of a potassium triborate dispersion containing 3 grams potassium triborate, 1.0 weight percent of a diparaffin polysulfide, 0.5 weight percent zinc dialkyldithiophosphate, and 0.5 weight percent of a phenolic antioxidant were added various amounts of other oil-soluble phosphorus compounds. Each sample was tested in a seal leakage apparatus comprising a sealed motor driven metal shaft passing through a reservoir of test oil. The seal comprised a Chicago Rawhide 10700 lip seal. Provisions were made for collecting any oil leakage. The shaft was rotated at 3200 revolutions per minute in each test. Each experiment was four hours long, started at room temperature, and test oil temperature rose to 60° C. (140° F.) in the first 30 minutes. New Chicago Rawhide 10700 lip seals were used for each test. After each experiment was complete, the amount of oil leakage, the seal wear, the shaft deposit weight, and the presence of ridges at the seal shaft contact line were recorded. Shaft ridges were evaluated visually and tactilely and rated as none, light, moderate or heavy. Formulations showing none or light ridges are considered satisfactory. The results are reported in Table I.

TABLE I

PROPERTIES OF BORATE DISPERSION CONTAINING WATER

| Example | Additive Amt (%) | % Type of Ammonium Phosphorus Compound ($PO_4$) | ($PO_3S$) | ($PO_2S_2$) | Ratio of P to B[6] | Water Level, % | Seal Wear, $10^{-3}$ In. | Shaft Deposits, mg | Leakage, ml | Shaft Ridges |
|---|---|---|---|---|---|---|---|---|---|---|
| 1 | — | — | — | — | — | — | 14 | 0 | 0 | none |
| 2 | — | — | — | — | — | — | 13 | 0 | 0 | none |
| 3 | — | — | — | — | — | 1 | 24 | 30 | Trace | heavy |
| 4 | 0.35% HE-320[1] | 0.04 | 0.06 | — | 0.011 | 1 | 23 | 24 | 42 | heavy |
| 5 | 0.50% HE-320[1] | 0.05 | 0.09 | — | 0.015 | 1 | 27,14 | 10,9 | 0 | moderate-heavy |
| 6 | 0.60% HE-320[1] | 0.07 | 0.11 | — | 0.020 | 1 | 6,15 | 7,4 | 0,0 | none |
| 7 | 0.75% HE-320[1] | 0.08 | 0.13 | — | 0.025 | 1 | 13,9 | 7 | 0 | none |
| 8 | 1.00% | 0.10 | 0.18 | — | 0.033 | 1 | 8 | 14 | 0 | none |

TABLE I-continued

PROPERTIES OF BORATE DISPERSION CONTAINING WATER

| Example | Additive Amt (%) | % Type of Ammonium Phosphorus Compound ($PO_4$) | ($PO_3S$) | ($PO_2S_2$) | Ratio of P to B[6] | Water Level, % | Seal Wear, $10^{-3}$ In. | Shaft Deposits, mg | Leakage, ml | Shaft Ridges |
|---|---|---|---|---|---|---|---|---|---|---|
| 9 | HE-320[1] .75% A-99[2] | 0.10 | 0.05 | 0.10 | 0.015 | 1 | 18,15 | 20,5 | 0,0 | none |
| 10 | 0.2% OAPD[3] | 0.2% | — | — | 0.023 | 1 | 6 | 8 | 0 | none |
| 11 | 0.2% DADP[5] | 0.2% | — | — | 0.027 | 1 | 7 | 4 | 0 | none |
| 12 | 0.2% OADEHDTP[4] | — | — | 0.20 | 0 | 1 | 34 | 48 | 0 | heavy |

Footnotes

[1]Hitec 320 (Edwin-Cooper) consists of 62 weight percent of a sulfurized olefin mixture (non-active), 10.4 percent phosphates, 17.6 percent monothiophosphates, and 10 percent rust inhibitors, diluents, etc. Most of the phosphorus is present as the oleylamine salt of a mixture of dibutylthiophosphate and dibutylphosphate.

[2]A-99 is Anglamol 99 (Lubrizol) consists of 61 weight percent of a sulfurized olefin mixture (non-active), 13.2 percent phosphates, 6.3 percent monothiophosphate, 13.5 percent dithiophosphate, and about 6 percent rust inhibitors, diluents, etc. Most of the phosphorus is present as the dodecylamine salt of a mixture of dihexylthiophosphate, dihexylphosphate, and dihexyldithiophosphate.

[3]oleylammonium dibutylphosphate.

[4]oleylammonium diethylhexyldithiophosphate.

[5]dodecylammonium dibutylphosphate.

[6]Weight ratio of phosphorus from phosphates and monothiophosphates to boron in the alkali metal borate dispersion.

Comparison of Examples 1 and 2 with Example 3 demonstrates that water contamination of a borate-containing lubricant causes substantial seal deterioration due to deposits formed in ridges at the seal shaft contact line which eventually leads to seal leakage.

Example 4 illustrates that the additive is not effective in preventing leakage because the ratio of phosphorus to boron is below the critical value (0.015).

Examples 5 and 9 illustrate that at the critical ratio of phosphorus to boron (0.015) sometimes the composition is effective and other times ineffective in preventing seal leakage.

Examples 6, 7, 8, 10 and 11 illustrate effective compositions in preventing seal leakage when the phosphorus to boron ratio is above the critical value (0.015).

Example 12 demonstrates that the dithiophosphates are not as effective in preventing seal leakage as the phosphate ($PO_4$) and monothiophosphates of the present invention.

What is claimed is:

1. A lubricant composition comprising an oil of lubricating viscosity having dispersed therein:

(a) 0.1 to 60 weight percent of a particulate hydrated alkali-metal borate and (b) an effective amount of an oil-soluble amine salt of a phosphorus compound to stabilize the lubricant composition against water contamination wherein said compound is of the formula:

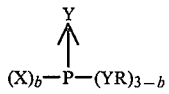

wherein:

b is 1, 2 or 3;

Y is O or optionally one Y is S;

R is an oil-solubilizing hydrocarbyl of 1 to 30 carbon atoms; and X is $ONH_{4-c}R'_c$ where c is 0, 1, 2, 3, or 4 and R' is a hydrocarbyl of 1 to 30 carbon atoms or an amino or hydroxy substituted alkyl group of 2 to 30 carbon atoms, and wherein the weight ratio of phosphorus to boron is greater than 0.014.

2. The lubricant composition of claim 1 wherein the weight ratio of phosphorus to boron is in the range of 0.015 to 0.05.

3. The lubricant composition of claim 1 having dispersed therein 0.01 to 5.0 weight percent of said oil-soluble phosphorus compound.

4. The lubricant composition of claim 1 having dispersed therein 0.1 to 2.0 weight percent of said oil-soluble phosphorus compound.

5. The lubricant composition of claim 1 wherein in the formula b is 1.

6. The lubricant composition of claim 1 wherein the weight ratio of phosphorus to boron is in the range of 0.02 to 0.03.

7. The lubricant composition of claim 6 wherein said phosphorus compound is a mixture of phosphates and monothiophosphates.

8. The lubricant composition of claim 7 wherein said phosphorus compound is a mixture of oleylammonium dibutylphosphate and oleylammonium dibutyl monothiophosphate.

9. The lubricant composition of claim 1 wherein said phosphorus compound is a mixture of dodecylammonium dihexylphosphate, dodecylammonium dihexylmonothiophosphate, and dodecylammonium dihexyldithiophosphate.

10. The lubricant composition of claim 1 wherein said phosphorus compound is oleylammonium dibutylphosphate.

* * * * *